United States Patent [19]

Sussman

[11] Patent Number: 4,750,446

[45] Date of Patent: Jun. 14, 1988

[54] INFLATABLE SAILBOAT

[76] Inventor: Robert A. Sussman, P.O. Box 3744, Tustin, Calif. 92860

[21] Appl. No.: 936,377

[22] Filed: Dec. 1, 1986

[51] Int. Cl.[4] ..... B63B 7/08

[52] U.S. Cl. ..... 114/345; 114/102; 114/39.1; 441/40

[58] Field of Search ..... 114/345, 343, 354, 39, 114/39.1, 89, 90, 97, 102, 103, 93, 165, 140; 441/40, 74

[56] References Cited

U.S. PATENT DOCUMENTS

| | | | |
|---|---|---|---|
| 2,140,250 | 12/1938 | Schlumph | 114/39 |
| 2,573,745 | 11/1951 | Wallenberg | 114/39 |
| 3,601,076 | 8/1971 | Meeks | 114/39 |
| 4,082,049 | 4/1978 | Nicol | 114/39 |
| 4,149,481 | 4/1979 | Leber | 114/345 X |
| 4,218,986 | 8/1980 | Hackney | 114/165 |
| 4,249,276 | 2/1981 | Snyderman | 114/345 |
| 4,348,779 | 9/1982 | Leber | 441/40 X |
| 4,624,208 | 11/1986 | Hyne | 114/345 |

FOREIGN PATENT DOCUMENTS

| | | | |
|---|---|---|---|
| 69091 | 1/1983 | European Pat. Off. | 114/345 |
| 1808211 | 7/1970 | Fed. Rep. of Germany | 114/39.1 |
| 3004416 | 8/1981 | Fed. Rep. of Germany | 114/39.1 |
| 213591 | 10/1985 | Japan | 114/39.1 |
| 2040830 | 9/1980 | United Kingdom | 114/39.1 |

*Primary Examiner*—Galen Barefoot
*Assistant Examiner*—Paul E. Salmon
*Attorney, Agent, or Firm*—Harris, Kern, Wallen & Tinsley

[57] ABSTRACT

An inflatable sailboat which may be constructed principally of plastic sheet stock and plastic tubing and be easily assembled for use and disassembled for storage and shipping. A sailboat with an inflatable hull having a plurality of tubing anchors mounted thereon for slidingly receiving anchor rods to locate and support a mast fitting on the upper side, a keel at the bow and a rudder at the stern. A mast and sail which are readily assembled and mounted on the hull and which are readily disassembled for storage and shipping.

5 Claims, 1 Drawing Sheet

INFLATABLE SAILBOAT

BACKGROUND OF THE INVENTION

This invention relates to an inflatable sailboat of the type suitable for use by children or by an adult in a swimming pool or small lake or the like, and in particular to a new and improved sailboat which is produced primarily of plastic sheet stock and plastic tubing so as to be inexpensive and easily assembled and disassembled permitting the product to be shipped and sold in the disassembled state, assembled by the purchaser for use, and disassembled for storage and transport.

It is an object of the present invention to provide a new and improved inflatable sailboat which is easily assembled, handled and disassembled by youngsters, and which is suitable for use and transport by youngsters or by an adult. It is another object of the invention to provide such a sailboat which is inexpensive to manufacture and sell. An additional object is to provide such a sailboat which can be produced primarily from stock materials and which is easily assembled and disassembled with small hand tools such as a screwdriver and a wrench or pliers. However it should be noted that the product is not limited to the toy field nor to use by children.

These and other objects, advantages, features and results will more fully appear in the course of the following description.

SUMMARY OF THE INVENTION

A sailboat with an inflatable hull and a plurality of tubing anchors attached to the hull. A mast fitting, typically a plastic molding, having angularly spaced horizontal openings for receiving anchor rods and a vertical opening for receiving a mast. The mast fitting is attached to the upper side of the hull adjacent the bow by anchor rods which slide into the horizontal openings of the fitting through tubing anchors on the hull, with one of the rods being U-shaped and also sliding into another anchor on the lower side of the hull and carrying a keel. A rudder carried on another U-shaped rod which slides into tubing anchors on the upper and lower sides of the hull adjacent the stern. A mast with telescoping mast sections and a stay ring support at the junction of two of the mast sections, with stays for supporting the mast. A sail which is assembled with the mast sections and stay ring and additional spar and boom to provide to provide a sail-mast assembly.

DESCRIPTION OF THE PREFERRED EMBODIMENT

Figure 1:
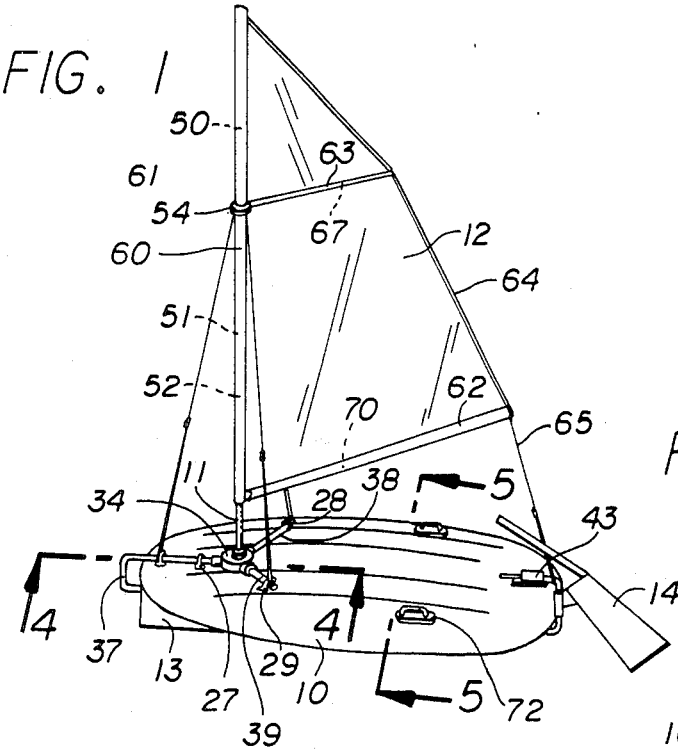
FIG. 1 is a perspective view of a sailboat incorporating the presently preferred embodiment of the invention.
Figure 2:
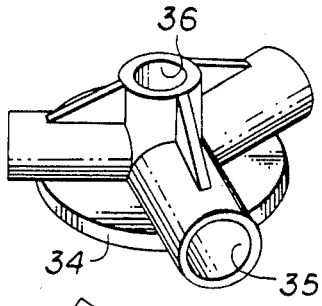
FIG. 2 is an enlarged perspective view of the mast fitting of the sailboat of FIG. 1.
Figure 3:
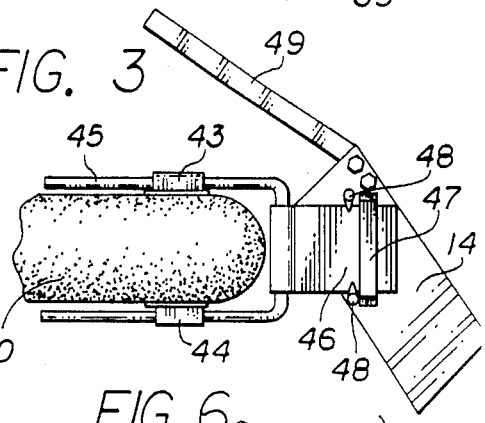
FIG. 3 is an enlarged partial sectional view illustrating the rudder of the sailboat of FIG. 1.
Figure 4:
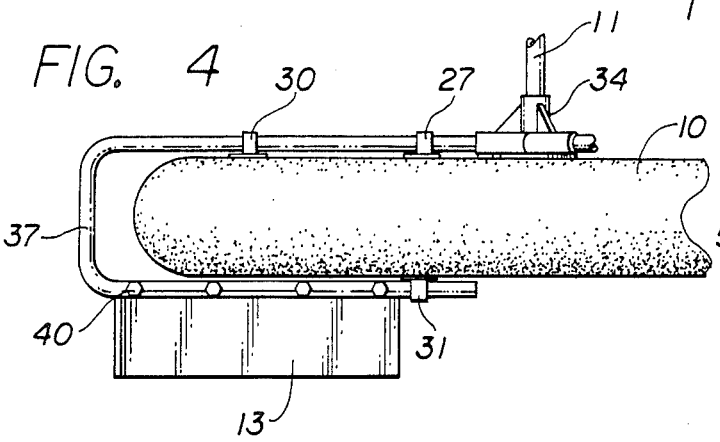
FIG. 4 is an enlarged partial sectional view illustrating the mast fitting and keel of the sailboat of FIG. 1.

The fully assembled sailboat is shown in FIG. 1 and includes a hull 10, mast 11, sail 12, keel 13, and rudder 14. The hull includes inner envelopes 17, 18 positioned within an outer envelope 19. Each of the envelopes preferably is made in the conventional manner from sheet plastic, with seams formed by heat sealing or by an adhesive or the like. Each of the envelopes has a conventional inflation plug 20, 21, 22. The inflation plug of each of the inner envelopes projects through the outer envelope to the exterior, with the outer envelope sealed against the inner envelope at this location. The inner envelopes are positioned along each side of the outer envelope for improved stability as well as safety.

A plurality of tubing anchors are attached to the hull at locations which will be described. Typically each tubing anchor is a plastic molding comprising a sleeve supported on a base, with the base attached to the hull by heat sealing or by an adhesive. Alternatively, the base and sleeve could be formed separately and then joined together. Three tubing anchors 27, 28, 29 are mounted on the upper side of the hull adjacent the bow, in spaced relation about a central point which defines the mast position. If desired, another tubing anchor 30 can be mounted on the upper side of the hull forward of the anchor 27. Another tubing anchor 32 is mounted on the lower side of the hull in line with the anchor 27.

A mast fitting 34 has three sleeve portions defining horizontal openings 35 and another sleeve portion defining a vertical opening 36. The mast fitting preferably is a molding or casting, but could be formed of four lengths of tubing mounted on a base. In use, the mast fitting 34 is positioned on the upper side of the hull between the anchors 27, 28, 29 and is fixed in place by anchor rods 37, 38 and 39. The anchor rod 37 is U-shaped, with its upper arm sliding through the anchors 30 and 27 into the mast fitting, and with its lower arm sliding through the anchor 31. The rods 38 and 39 are straight sections with the rod 38 sliding through the anchor 28 into the mast fitting and with the rod 39 sliding through the anchor 29 into the mast fitting. Typically all the rods are plastic tubing but could be of metal and could be solid rather than tubular. The keel 13 is carried on the lower arm of the U-shaped anchor rod 37, typically being attached by bolts 40.

Additional tubing anchors 43, 44 are attached to the hull on the upper and lower sides, respectively, adjacent the stern. The rudder 14 is attached to a blade 46 pivotally mounted on the bight of a U-shaped anchor rod 45, with the arms of the rod 45 sliding into the anchors 43, 44. In the embodiment illustrated, the rudder 14 is attached to the blade 46 by sliding the free end of the blade into a bracket 47 on the rudder 14, and clamping the blade and rudder together by clips 48. A tiller 49 is attached to the upper end of the rudder 14.

Typically the mast 11 is formed of three sections of tubing, either plastic or metal, and comprising an upper section 50, a middle section 51 and a lower section 52. The upper end of the mast section 52 is telescoped into the lower end of the mast section 51, and the upper end of the mast section 51 is telescoped into the lower end of the mast section 50, the latter assembly being shown in FIG. 6 with the mast section 51 having an upper portion 53 of reduced diameter so as to slide into the mast section 50. A stay ring 54 has a central opening 55 for sliding over the upper end 53, and three additional openings 56 for terminating of stays 57. The lower ends of the stays may be connected to the anchor rods 37, 38, 39 at the tubing anchors 30, 28, 29, respectively.

Figure 6:
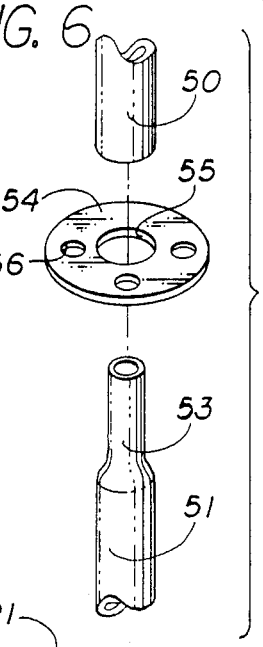
FIG. 6 is an exploded view illustrating a step in the assembly of the mast.
Figure 5:
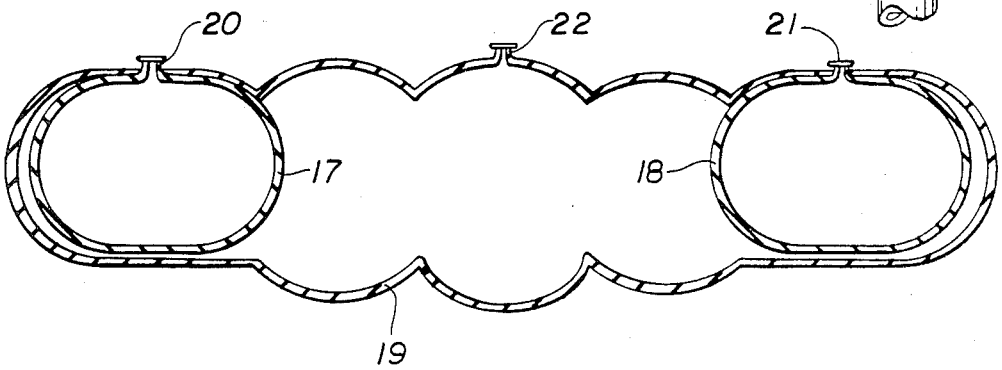
FIG. 5 is an enlarged sectional view taken along the line 5—5 of FIG. 1.

The sail 12 has a vertical pocket 60 along the forward edge, with the pocket interrupted at an opening 61. The sail also has a horizontal pocket 62 on the bottom, a transverse pocket 63 which terminates adjacent the opening 61, and a pocket 64 along the trailing edge. Typically the sail is made of flexible plastic sheet stock and the pockets are produced by folding over an edge or adding a strip by stitching or heat or adhesive sealing. In assembly, the upper mast section 50 is inserted in the upper end of the pocket 60, the lower mast section 52 is inserted into the middle mast section 51 and this assembly is inserted in the lower portion of the pocket 60. The stay ring 54 is positioned at the opening 61, and the upper end 53 of the middle mast section 51 is passed through the opening 55 of the stay ring into the upper mast section 50, as shown in FIG. 6. A spar 67 is inserted into the pocket 63 and a boom 70 is inserted into the pocket 62. The line 65 has previously been inserted into the pocket 64, and may be anchored to the upper end of the mast. With this construction, the sail may be rotated on the mast and controlled by the line 65.

Hand grips 72, typically plastic moldings, may be attached to the upper side of the hull for use in handling and sailing the boat. The sailboat is assembled by inflating the envelopes, preferably the envelope 17, 18 at the outer edges first and then the envelope 19. The keel is attached to the anchor rod 37, the mast fitting 34 is positioned on the hull, and the anchor rods 37, 38 and 39 are slid into position. The rudder is attached to the rudder blade and the anchor rod 45 is slid into position. The mast and sail are assembled as previously described, the lower end of the mast is set in the mast fitting, and the stays are attached. The boat is now ready for launching. The sailboat is disassembled for storage or transport by reversing the process. Thus it is seen that the sailboat is easily manufactured preferably using plastic sheet stock and plastic tubing, with some plastic moldings and conventional fasteners and lines. Typically the mast is formed of aluminum tubing and the spar and boom may be aluminum or plastic as desired. The vessel may be packed, stored and transported in a very small container and is easily and quickly assembled and disassembled.

I claim:

1. In a sailboat, the combination of:

an inflatable hull having an upper side and a lower side, a bow and a stern, and having a plurality of tubing anchors mounted thereon, with three of said anchors on said upper side adjacent said bow;

a mast fitting having three angularly spaced horizontal openings and a vertical opening;

three mast anchor rods;

with said mast fitting resting on said upper side of said hull between said three anchors, and with each of said mast anchor rods positioned in a mast fitting horizontal opening and in an anchor for holding said mast fitting onto said hull;

a fourth tubing anchor mounted on said lower side of said hull adjacent said bow; and with one of said mast anchor rods being U-shaped with one arm of said U sliding into said fourth anchor and with the other arm of said U sliding into one of said mast fitting horizontal openings through one of said anchors on said hull upper side.

2. A sailboat as defined in claim 1 including a keel attached to said one arm of said U-shaped anchor rod.

3. A sailboat as defined in claim 2 including:

upper and lower rudder anchors on said upper and lower sides of said hull, respectively, adjacent said stern;

a U-shaped rudder carrier rod having spaced arms with a bight therebetween, with said arms slideable into said rudder anchors;

a rudder; and rudder support means for pivotally mounting said rudder on the bight of said rudder carrier rod.

4. A sailboat as defined in claim 3 wherein said rudder support means includes a blade pivotally mounted on said rudder carrier rod, a bracket on said rudder for slidingly receiving said blade, and clip means for holding said blade and rudder together.

5. In a sailboat, the combination of:

an inflatable hull having an upper side and a lower side, a bow and a stern, and having a plurality of tubing anchors mounted thereon, with three of said anchors on said upper side adjacent said bow;

a mast fitting having three angularly spaced horizontal openings and a vertical opening;

three mast anchor rods, with said mast fitting resting on said upper side of said hull between said three anchors, and with each of said mast anchor rods positioned in a mast fitting horizontal opening and in an anchor for holding said mast fitting onto said hull;

a fourth tubing anchor mounted on said lower side of said hull adjacent said bow, with one of said mast anchor rods being U-shaped with one arm of said U sliding into said fourth anchor and with the other arm of said U sliding into one of said mast fitting horizontal openings through one of said anchors on said hull upper side;

a keel attached to said one arm of said U-shaped anchor rod;

upper and lower rudder anchors on said upper and lower sides of said hull, respectively, adjacent said stern;

a U-shaped rudder carrier rod having spaced arms with a bight therebetween, with said arms slideable into said rudder anchors;

a rudder;

rudder support means for pivotally mounting said rudder on the bight of said rudder carrier rod, said rudder support means including a blade pivotally mounted on said rudder carrier rod, a bracket on said rudder for slidingly receiving said blade, and clip means for holding said blade and rudder together;

a mast with a lower end for sliding insertion into said mast fitting vertical opening, said mast comprising a plurality of tubular mast sections with one of said mast sections having an end of reduced diameter for telescopingly engaging another of said mast sections; and a stay ring having a central opening for said mast section end of reduced diameter positioned therein with said stay ring retained between said mast sections, said stay ring having a plurality of additional openings for receiving mast stays.

* * * * *